United States Patent [19]

Wochnowski et al.

[11] Patent Number: 4,513,759

[45] Date of Patent: Apr. 30, 1985

[54] APPARATUS FOR EXPELLING MOISTURE FROM TOBACCO OR THE LIKE

[75] Inventors: Waldemar Wochnowski, Hamburg-Meiendorf; Reinhard Hohm, Pinneberg; Reinhard Liebe; Manfred Muss, both of Hamburg, all of Fed. Rep. of Germany

[73] Assignee: Hauni-Werke Körber & Co. KG, Hamburg, Fed. Rep. of Germany

[21] Appl. No.: 391,462

[22] Filed: Jun. 23, 1982

[30] Foreign Application Priority Data

Jul. 7, 1981 [DE] Fed. Rep. of Germany ..... 3126717

[51] Int. Cl.[3] ..... A24C 9/00; A24C 3/04

[52] U.S. Cl. ..... 131/303; 34/46; 131/305

[58] Field of Search ..... 131/305, 910, 302, 303; 34/46, 48, 50

[56] References Cited

U.S. PATENT DOCUMENTS

| | | | |
|---|---|---|---|
| 3,372,488 | 3/1968 | Koch et al. | 131/303 |
| 3,731,286 | 5/1973 | Graalmann et al. | 131/305 |
| 3,905,123 | 9/1975 | Fowler et al. | 34/46 |
| 3,906,961 | 9/1975 | Rowell et al. | 131/303 |
| 3,948,277 | 4/1976 | Wochnowski et al. | 131/303 |
| 3,985,145 | 10/1976 | Broscheit et al. | 131/303 |
| 4,045,657 | 8/1977 | Falke | 131/910 |
| 4,069,830 | 1/1978 | Thiele et al. | 131/303 |
| 4,255,869 | 3/1981 | Quester et al. | 34/46 |

FOREIGN PATENT DOCUMENTS 596376 4/1960 Canada .

*Primary Examiner*—V. Millin
*Assistant Examiner*—Harry Macey
*Attorney, Agent, or Firm*—Peter K. Kontler

[57] ABSTRACT

Apparatus for expelling moisture from a continuous stream of tobacco which passes through a conditioning zone defined by a hollow rotary drum-shaped dryer has a control unit employing a computer whose output signal is indicative of the quantity of moisture to be expelled from tobacco per unit of time during travel through the dryer in order to ensure that the final moisture content of tobacco will match a predetermined value. The signal which is generated by the computer is used to regulate a valve in a conduit connecting the conditioning zone with a source of steam. The rate of steam admission or the pressure of admitted steam increases when the quantity of moisture which is contained in tobacco entering the dryer per unit of time decreases and vice versa. This ensures that the total quantity of moisture in the conditioning zone remains at least substantially constant even though the moisture content and/or the quantity of tobacco in the stream entering the dryer varies within a wide range. The wall or walls of the dryer can be indirectly heated by steam. A threshold circuit can be installed between the adjusting device for the steam valve and the output of the computer if the conditioning zone is to receive steam only when the initial moisture content of tobacco or the quantity of tobacco which is admitted into the conditioning zone per unit of time is so low that the wall or walls of the dryer would expel excessive quantities of moisture therefrom.

16 Claims, 2 Drawing Figures

APPARATUS FOR EXPELLING MOISTURE FROM TOBACCO OR THE LIKE

BACKGROUND OF THE INVENTION

The present invention relates to apparatus for conditioning tobacco or similar materials including reconstituted and artificial tobacco. More particularly, the invention relates to improvements in apparatus for reducing the moisture content of natural, reconstituted and/or artificial tobacco to a preselected value while the tobacco is advanced along a predetermined path by a transporting unit, preferably a transporting unit which includes a hollow rotary dryer defining a conditioning zone for successive lengths of a preferably continuous stream of particles of tobacco or the like (hereinafter called tobacco for short). Still more particularly, the invention relates to improvements in apparatus wherein the wall or walls of the aforementioned rotary dryer are preferably heated by a fluid medium, such as steam and/or hot air, in order to enable the wall or walls to transfer heat to tobacco particles in the dryer and to thereby expel moisture from such material.

It is already known to utilize a rotary drum-shaped dryer for conditioning of successive increments of a continuous tobacco stream in order to reduce the moisture content of tobacco to a preselected value which is best suited for further processing of tobacco in a cigarette rod making machine or the like. The means for heating the wall or walls of the rotary dryer can comprise elongated pipes or plates which convey steam or another heated fluid (such as a hot gas or hot oil) in order to heat the wall or walls as well as to directly heat the tobacco particles which come in contact therewith. Such pipes or plates can constitute, or perform the function of, orbiting blades or paddles which agitate the constituents of the tobacco stream during travel through the conditioning zone in order to ensure a more uniform heating and drying action. The pipe or pipes and/or the plate or plates can be said to constitute component parts of the wall or walls, i.e., constituents of the rotary dryer, because they also transmit heat from the fluid heating medium to the particles of tobacco in the conditioning zone. Reference may be had to commonly owned U.S. Pat. No. 3,429,317 granted Feb. 25, 1969 to Hans Koch et al.; this patent describes and shows a rotary drum-shaped dryer which constitutes one element of a tobacco transporting unit and whose cylindrical wall is heated by axially parallel pipes connected to a source of hot steam. In the apparatus which is described and shown in the patent to Koch et al., a detector monitors the initial moisture content of tobacco and the signals which are generated by such detector are utilized to regulate the heat content of a hot air stream which is admitted into the inlet of the conditioning zone, i.e., into the tobacco-receiving end of the rotary drum-shaped dryer. The heat content of steam which is used to heat the cylindrical wall of the dryer, and which furnishes the major part of the heating and drying action, is regulated in dependency on deviations of the monitored final moisture content of dried tobacco from a preselected value. The quantity of hot air which is admitted into the conditioning zone of a modern tobacco dryer should be as low as possible and the temperature in the conditioning zone should be very high. Such mode of drying cannot be achieved with the apparatus of Koch et al. because the patented apparatus requires substantial quantities of hot air in order to immediately compensate for pronounced fluctuations in the initial moisture content of tobacco.

If the heating action of a conventional dryer upon the particles of tobacco in the drying or conditioning zone is to be reduced, for example, because the quantity of moisture which is to be expelled from tobacco per unit of time is reduced (this takes place when the quantity of tobacco particles per unit length of the tobacco stream and/or the initial moisture content of tobacco particles decreases), it is necessary to reduce the pressure of steam which is used to heat the wall or walls of the dryer. This creates problems when the pressure of steam decreases to and/or below a certain value. For example, if the pressure of steam which is used to heat the wall or walls of the rotary dryer drops to or below 1 bar, this eliminates the possibility of maintaining a predictable (unequivocal) relationship between the steam pressure and steam temperature on the one hand and the drying action on the other hand. Therefore, automatic dryers are normally equipped with means for establishing a lower limit for the drying action; however, this can present problems under certain circumstances, for example, when the operating conditions are such that one cannot ensure the evaporation of a minimal quantity of moisture per unit of time. In such instances, even the aforementioned minimal or rock-bottom drying or heating action (quantity of transferred heat per unit of time) would lead to highly undesirable overdrying of tobacco particles.

OBJECTS AND SUMMARY OF THE INVENTION

An object of the invention is to provide a tobacco drying apparatus with novel and improved controls which ensure that the final moisture content will match the desired final moisture content, even under those circumstances when heretofore known apparatus cannot ensure predictable drying.

Another object of the invention is to provide an apparatus wherein the heating action can be caused to rapidly or immediately conform to the momentary requirements to thus ensure that the final moisture content of tobacco will match, or will be sufficiently close to, the desired or optimum final moisture content.

A further object of the invention is to provide novel and improved controls for use in a tobacco processing apparatus wherein successive increments of a continuous tobacco stream are relieved of moisture during transport through a conditioning zone which is defined by rotary drum-shaped dryer means.

An additional object of the invention is to provide an apparatus wherein the quantity of heat per unit of time (heating action) which is applied to tobacco in order to evaporate the desired amounts of moisture therefrom can be ensured even if the total heat supplied to the dryer is less than a predetermined quantity.

Another object of the invention is to provide a tobacco conditioning apparatus wherein the quantity of fluid which is admitted into the conditioning zone to come in direct contact with the particles of tobacco is relatively small and wherein the quantity of hot air is much less than in heretofore known apparatus without in any way affecting the ability of the apparatus to rapidly or immediately react to abrupt and/or pronounced changes in the quantity of admitted tobacco per unit of time and/or in the initial moisture content of tobacco.

An additional object of the invention is to provide a novel and improved method of expelling moisture from tobacco in the conditioning zone of a rotary drum-shaped dryer.

One feature of the invention resides in the provision of an apparatus for conditioning tobacco or a similar material. The apparatus comprises a transporting unit including a hollow rotary dryer which defines a conditioning zone for the passage of a preferably continuous stream of moisture-containing material therethrough, means for heating the dryer so that the latter transmits heat to and thereby expels moisture from the material during transport through the conditioning zone, and control means including means for monitoring the quantity of moisture in the material entering the conditioning zone per unit of time, a source of steam, adjustable means for admitting steam from the source into the conditioning zone, and means for adjusting the admitting means so as to increase the quantity of admitted steam per unit of time when the quantity of moisture in the material entering the conditioning zone per unit of time decreases and vice versa. This amounts to an artificial increase of the quantity of moisture in the conditioning zone when the total quantity of moisture entering such zone in the material to be treated is less than anticipated, and vice versa.

The monitoring means includes means for generating first signals which denote the initial moisture content of material entering the conditioning zone, and the control means preferably further comprises means for processing such signals. The processing means includes means for generating second signals denoting the quantity of moisture to be expelled from the material in the conditioning zone in order to ensure that the moisture content of material leaving the conditioning zone will at least approximate a predetermined optimum value. The adjusting means for the steam admitting means (such steam admitting means can constitute a regulating valve, and the adjusting means can constitute or include a servo mechanism which can change the position of the valving element in the valve) is then responsive to the second signals.

The means for heating the dryer preferably includes a source of steam or another heated fluid.

The aforementioned processing means can comprise a commercially available computer having a first input for the first signals, a second input, and an output for the second signals. The control means then further comprises means for monitoring the quantity of material entering the conditioning zone per unit of time and including means (such as a suitable transducer) for transmitting to the second input of the computer third signals which denote the monitored quantity of material.

As mentioned above, the steam admitting means can constitute an adjustable regulating valve which is installed in a conduit connecting the source of steam with the conditioning zone.

The apparatus can further comprise means for activating the adjusting means for the regulating valve only when the quantity of moisture in material which is admitted into the conditioning zone per unit of time drops below a predetermined value, for example, to a value at which the heating action of the dryer would be excessive (i.e., at which the dryer would expel excessive quantities of moisture from the material which advances through the conditioning zone). The just discussed activating means can comprise a threshold circuit which is connected between the output of the computer and the adjusting means for the steam regulating valve.

The heating means for the dryer is preferably adjustable, and the apparatus then further comprises second control means having means for monitoring the (final) moisture content of the material leaving the conditioning zone and means for adjusting the heating means when the monitored final moisture content deviates from a predetermined value.

The aforementioned transporting unit comprises means (e.g., a chute) for feeding material to a predetermined portion of the inlet of the dryer. The control means including the steam admitting means can comprise a conduit for the steam regulating valve, and the discharge end of such conduit is preferably closely or immediately adjacent to the locus where the chute admits successive increments of a stream of material into the inlet of the dryer. Furthermore, the apparatus preferably comprises a source of heated fluid (preferably air) and second conduit means for admitting hot fluid from such source into the conditioning zone. The discharge end of the second conduit means is preferably closely or immediately adjacent to the discharge end of the steam conduit and/or to the locus of admission of material into the inlet of the dryer. As stated above, the source of heated fluid which is conveyed by the second conduit means can be air and/or another oxygen-containing gas.

Heating of the material in the conditioning zone entails the development of vapors, and the apparatus preferably further comprises means for evacuating vapors from the conditioning zone. Such evacuating means can comprise conduit means for extraction of vapors from the conditioning zone, adjustable flow restricting means (e.g., a butterfly valve) in the conduit means, and means (e.g., a servo motor) for adjusting the flow restricting means as a function of the rate of admission of steam into the conditioning zone. The just mentioned adjusting means is preferably arranged to increase the rate of extraction of vapors from the conditioning zone when the rate of steam admission into the dryer increases and vice versa.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
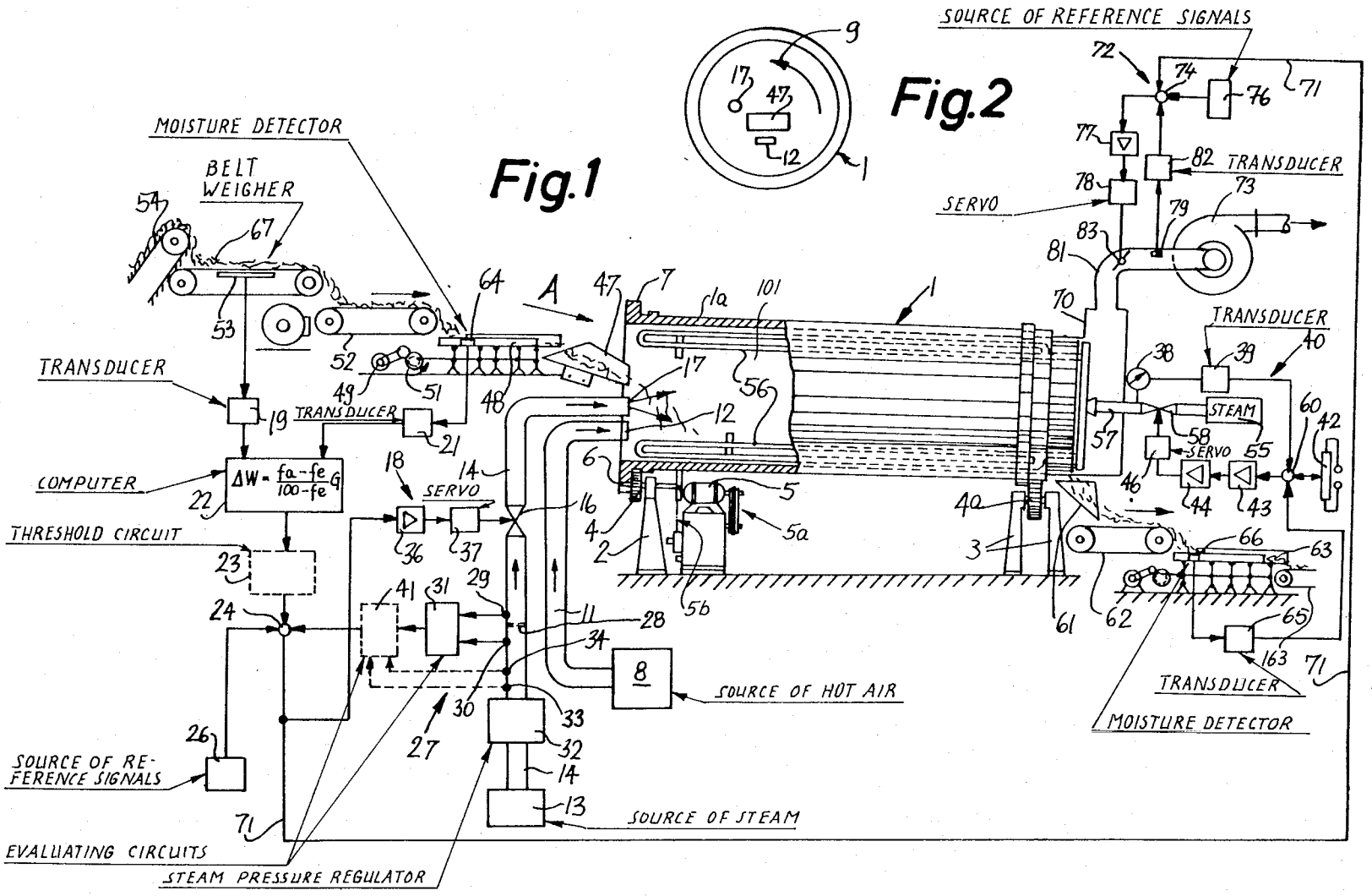
FIG. 1 is a partly elevational and partly diagrammatic view of a conditioning apparatus which embodies the invention, a portion of the rotary dryer being shown in an axial sectional view.
FIG. 2 is an end elevational view of the dryer as seen in the direction of arrow A in FIG. 1.

The apparatus which is shown in FIG. 1 comprises a hollow rotary drum-shaped dryer 1 which is rotatable about a slightly inclined (downwardly sloping) axis by one or more gears 6 meshing with a ring gear 7 at the left-hand axial end (inlet end) of the dryer. The gear 6 is driven by a variable-speed electric motor 5 through suitable belt or chain transmissions 5*a* and 5*b*. The dryer 1 is rotatably supported by two groups of rollers 4, 4*a* which are mounted in uprights 2, 3 at the respective axial ends of the dryer. The direction in which the motor 5 drives the dryer 1 is indicated by the arrow 9 shown in FIG. 2.

The means for feeding a continuous stream of tobacco particles 67 into the inlet of the dryer 1 comprises a downwardly sloping chute 47 which, in turn, receives particles of tobacco from a trough-shaped vibratory conveyor 48. The latter is vibrated or agitated by a motor 49 through the medium of an operative connection including an eccentric or crank drive 51 and links or leaf springs coupling the part 51 with the trough of the conveyor 48. An upwardly sloping carded belt conveyor 54 draws tobacco particles 67 from a magazine (not shown) and delivers successive increments of a preferably continuous tobacco stream onto the endless belt of a belt weigher or conveyor-type weigher 53 capable of generating signals denoting the weight or mass of successive unit lengths (quantity per unit of time) of the tobacco stream on the upper reach of its endless belt. The latter delivers tobacco particles 67 to the upper reach of a further endless belt or band conveyor 52 which supplies tobacco into the trough of the conveyor 48.

The right-hand end of the dryer 1 discharges dried tobacco particles into a second downwardly inclined chute 61 serving to shower successive increments of the treated tobacco stream onto an endless belt conveyor 62 disposed upstream of a second vibratory trough-type conveyor 63. A take-off conveyor 163 accepts tobacco from the trough of the conveyor 63 for delivery to storage or to a processing station.

The vibratory trough type conveyors 48 and 63 are respectively equipped with moisture detectors 64 and 66 which serve to respectively ascertain the initial moisture content fa of tobacco particles 67 ahead of the conditioning zone 101 in the dryer 1 and the final moisture content fe of tobacco particles downstream of the dryer. The detectors 64 and 66 are high-frequency monitoring devices which are designed to furnish signals denoting the measured moisture content in percent by weight. Reference may be had to commonly owned U.S. Pat. No. 3,372,488 granted Mar. 12, 1968 to Hans Koch et al. The disclosure of this patent, which fully describes and shows moisture detector means of the type capable of being used in the apparatus of the present invention, is incorporated herein by reference.

The means for heating the cylindrical wall 1*a* of the dryer 1 comprises a steam generator 55 which supplies steam to elongated pipes 56 disposed in the interior of the dryer 1 and extending in substantial parallelism with the axis of the wall 1*a*. Such pipes not only serve to heat the wall 1*a* but they also act as paddles, blades or analogous agitating means for that portion of the tobacco stream which advances from the chute 47 at the inlet end to the chute 61 at the discharge end or outlet of the dryer 1. The pipes 56 receive fresh steam from a conduit 57 which contains an adjustable regulating valve 58 and is connected to the outlet of the steam generator 55. The conduit 57 can include two coaxial pipes the inner of which supplies fresh steam from the steam generator 55 to the pipes 56 and the outer of which returns spent steam from the pipes 56 to the steam generator or to another location. Such types of conduits between a steam generator and pipes in the interior of a revolving drum are known in this art. Reference may be had to United States patents granted to the assignee of the present application.

The means for adjusting the regulating valve 58 in the conduit 57 comprises a control unit or circuit 40 which is designed to regulate the pressure of steam in the pipes 56 as a function of the intensity or another characteristic of signals generated by the moisture detector 66, i.e., as a function of the monitored final moisture content fe of tobacco particles 67 forming the stream in the trough of the conveyor 63. The output of the moisture detector 66 is connected with the input of a transducer 65 which transmits a proportional electric signal to one input of a signal comparing stage 60 in the control unit 40. A second input of the signal comparing stage 60 is connected with a source 42 of reference signals (e.g., an adjustable potentiometer) which transmits an adjustable reference signal (basic or primary reference signal). The reference signal from the source 42 is superimposed upon the signal which is transmitted by the transducer 65, and the resulting signal is used as a reference signal for a subordinate or cascade-control unit which determines the setting of the regulating valve 58 and hence the pressure of steam in the conduit 57. Such pressure is monitored by a gauge 38 which transmits signals denoting the monitored steam pressure to a transducer 39 which latter, in turn, transmits corresponding or proportional electric signals to a third input of the signal comparing stage 60. The signal at the output of the stage 60 is indicative of the difference between the composite reference signal obtained from the signals supplied by 42 and 65, and the signal from the transducer 39, and such resultant signal is transmitted to the valve 58 through a variable gain amplifier 43, an operational amplifier 44 and a servo 46 whose output element is coupled to and constitutes a means for adjusting the valving element of the valve 58.

The inlet of the drum 1 receives heated air from a source 8 through a conduit 11. The discharge end 12 of the conduit 11 is adjacent to the locus of admission of tobacco 67 into the dryer 1, i.e., the discharge end 12 is immediately or closely adjacent to the discharge end of the tobacco feeding chute 47 (see also FIG. 2). If necessary, the heat content of hot air which is furnished by the source 8 can be regulated in dependency on the initial moisture content of tobacco and/or in dependency on the mass of tobacco per unit of time. The manner in which this is accomplished is disclosed, for example, in commonly owned U.S. Pat. No. 3,429,317 granted Feb. 25, 1969 to Koch et al. The disclosure of this patent is incorporated herein by reference.

The apparatus further comprises a source 13 of saturated steam. This source is connected with the inlet of the dryer 1 by a conduit 14 which contains an adjustable regulating valve 16 and the discharge end 17 of which is also close to the locus of admission of tobacco particles 67 into the dryer 1, i.e., close to the discharge end 12 of the hot air supply conduit 11 and to the discharge end of the tobacco feeding chute 47 (see also FIG. 2).

The control means 18 for effecting adjustments of the regulating valve 16 in the conduit 14 which supplies saturated steam to the interior of the dryer 1 receives signals from a transducer 19 of the weigher 53 and from a transducer 21 of the moisture detector 64. The outputs of these transducers transmit electric signals fa and G (respectively denoting the mass or weight per unit of time and the initial moisture content of tobacco in percent by weight) to the corresponding inputs of a signal processing computer 22. The signal at the output of the computer 22 is indicative of Δw (in kg/unit of time) wherein $$\Delta w = \frac{fa - fe}{100 - fe} G.$$

In the above equation, fe denotes the desired or optimum final moisture content of tobacco.

The computer 22 may be a commercially available instrument, e.g., of the type disclosed in U.S. Pat. No. 4,045,657 granted Aug. 30, 1977 to Falke. The computer of this patent (whose disclosure is incorporated herein by reference) is designed to calculate the dry mass of tobacco. However, once the dry mass is ascertained, and once one obtains the signal G (from the belt weigher 53), the value of Δw can be readily ascertained by resorting to a simple subtracting circuit of any known design. In an analogous manner, the amount of moisture in tobacco can also be calculated by a detector of the type shown and described at D in U.S. Pat. No. 2,768,629 granted Oct. 30, 1956 to Maul.

The signal at the output of the computer 22 constitutes a reference signal which can be transmitted (if necessary, through a threshold circuit 23 to be described hereinafter) to one input of a signal comparing stage 24 which has a second input connected to a source 26 of basic reference signals. A third input of the stage 24 receives a signal from a monitoring circuit 27 serving to ascertain the quantity of steam in the conduit 14. This monitoring circuit comprises a flow restrictor 28 which is installed in the conduit 14 upstream of the valve 16. The monitoring circuit 27 further comprises a first pressure gauge 29 downstream and a second pressure gauge 30 upstream of the flow restrictor 28. Electric signals which are generated by the transducers of the gauges 29 and 30 are transmitted to an evaluating circuit 31 whose output is connected with the third input of the signal comparing stage 24. The signal at the output of the evaluating circuit 31 is indicative of the quantity of steam flowing through the flow restrictor 28. An instrument which can be used in the apparatus of FIG. 1 and which embodies components corresponding to the just described parts 28, 29, 30 and 31 is manufactured and sold (under the designation Samson Typ 91 and Samson Typ 2FR) by the firm Samson Mess—u. Regeltechnik, Frankfurt/Main, Federal Republic Germany. It is to be noted here that a prerequisite for satisfactory operation of the monitoring circuit 27 is that the pressure of steam which is supplied by the source 13 does not deviate excessively from a predetermined value. Therefore, the conduit 14 for admission of steam into the inlet of the dryer 1 preferably further contains a steam pressure regulator 32 which is installed upstream of the flow restrictor 28 and serves to maintain the pressure of stream flowing to the flow restrictor 28 at or close to a preselected value. If the pressure of saturated steam which is supplied by the source 13 is to fluctuate within a rather wide range, e.g., between ½ and 5 bar, the apparatus is preferably provided with an additional or auxiliary evaluating circuit or arrangement 41 (indicated by broken lines because it constitutes an optional feature of the improved apparatus) which is designed to furnish signals denoting the initial pressure and temperature of saturated steam. To this end, two inputs of the evaluating circuit 41 are connected with instruments (a pressure gauge 33 and a thermometer 34) in the conduit 14 upstream of the flow restrictor 28. The third input of the auxiliary evaluating circuit 41 (if such circuit is used in the improved apparatus) is connected with the output of the evaluating circuit 31, and the output of the circuit 41 is connected with the third input of the signal comparing stage 24.

The signal at the output of the signal comparing stage 24 is transmitted to a variable gain amplifier 36 of the control unit 18. The output of the amplifier 36 transmits appropriate signals to the input of a servo 37 which can adjust the flap or another suitable valving element of the regulating valve 16 in the steam supply conduit 14.

The signal at the output of the signal comparing stage 24 is further transmitted to a control unit 72, and more particularly to a signal comparing stage 74 of the unit 72. The latter serves to regulate the rate of outflow of vapors (namely, spent air which is laden with water vapors) from the interior of the dryer 1. The operative connection between the signal comparing stages 24 and 74 is represented symbolically by a conductor 71. The vapors are drawn from the interior of the dryer 1 by a fan 73 or another suitable fluid extracting device through an evacuating conduit or pipe 81 which is connected to a vapor-collecting hood 70 at the discharge end of the dryer 1. The arrangement is such that the rate of evacuation of vapors via conduit 81 is increased when the rate of steam admission via conduit 14 is increased, and vice versa. The signal at the output of the signal comparing stage 24 constitutes a reference signal and is transmitted to one input of the stage 74 another input of which receives a reference signal from a source 76 of basic reference signals. A gauge 79 or another suitable detector monitors the quantity of vapors in the conduit 81 and transmits appropriate signals to a third input of the signal comparing stage 74 through a suitable transducer 82. The electric signal which is transmitted by the output of the transducer 82 is proportional to the quantity of vapors in the conduit 81 downstream of a flow restricting butterfly valve 83 which is adjustable in response to signals transmitted by the output of the signal comparing stage 74 through a variable-gain amplifier 77 and a servo 78. The signal which is transmitted to the amplifier 77 is indicative of the difference between the actual quantity of vapors downstream of the valve 83 in the conduit 81 and the desired or optimum quantity. The servo 78 causes the valve 83 to enlarge or reduce the effective cross-sectional area of the respective portion of the conduit 81 is a function of deviation of actual quantity of vapors from the desired or optimum quantity.

The operation of the apparatus which is shown in FIGS. 1 and 2 is as follows

Tobacco particles 67 which are supplied by the carded conveyor 54 are transferred onto the upper reach of the belt conveyor of the weigher 53 whose transducer 19 transmits electric signals denoting the mass stream (namely, the mass of tobacco per unit of time). The particles 67 thereupon advance with the upper reach of the belt conveyor 52, in the trough of the vibratory conveyor 48 and through the chute 47 on their way into the inlet of the dryer 1. The transducer 21 of the moisture detector 64 transmits electric signals denoting the initial moisture content fa of tobacco (namely the share of moisture in the total mass of tobacco in percent).

Owing to slight inclination of the dryer 1, the stream of tobacco particles 67 advances from the inlet toward the discharge end of the conditioning zone in the dryer and is thoroughly agitated by the elongated pipes 56 which heat the particles of tobacco as well as the wall 1*a*. As mentioned above, the pipes 56 act not unlike blade or paddles to thus ensure uniform and thorough intermixing of the contents of the tobacco stream. This stream is heated and dried to the desired final moisture content fe by the pipes 56, by the wall 1*a* and also by heated air which is admitted into the conditioning zone by the discharge end 12 of the conduit 11.

The extent to which the wall 1*a* of the dryer 1 is heated is a function of the intensity or another characteristic of electric signals which are transmitted by the output of the transducer 65 forming part of the moisture detector 66 in the trough of the vibratory conveyor 63 which receives dried tobacco particles 67 from the chute 61 and conveyor 62. The signal which is generated by the transducer 65 is transmitted to the corresponding input of the signal comparing stage 60 and constitutes a reference signal for the subordinate or cascade-control unit which determines the setting of the valving element forming part of the regulating valve 58 in the conduit 57. If the intensity or another characteristic of the just discussed reference signal which is transmitted by the transducer 65, plus the reference signal from the source 42, deviates from the corresponding characteristic of the signal which is generated by the pressure gauge 38 and is converted into an electric signal by the transducer 39 (to denote the actual pressure of stem in the pipe 57 downstream of the regulating valve 58), the output of the signal comparing stage 60 transmits a signal which is amplified at 43 and 44 prior to being applied to the servo 46 which adjusts the regulating valve 58 accordingly. The adjustment is such that the difference between the actual-pressure signal at the output of the transducer 39 and the combined reference signal (supplied by the source 42 and transducer 65) disappears. Steam which is supplied by the steam generator 55 furnishes the heating action for the pipes 56 and wall 1*a*, i.e., the heating action of the parts 1*a* and 56 upon the particles 67 which are then located in the conditioning zone 101 (the space surrounded by the wall 1*a*). The control unit 40 serves to eliminate, or to compensate for, long-range fluctuations of the moisture content of dried tobacco particles 67.

The moisture content of tobacco 67 can be influenced much more rapidly by the aforedescribed novel control unit 18. The electric signals which are generated by the transducer 19 of the weigher 53 and the electric signals which are generated by the transducer 21 of the moisture detector 64 are transmitted to the corresponding inputs of the computer 22 which can be of the analog or digital type and whose output transmits the signal $\Delta w$ (namely, a signal denoting the quantity of moisture per unit of time which must be expelled from tobacco particles 67 in order to obtain the desired final moisture content fe. The signal at the output of the computer 22 transmits the signal denoting the value w as a reference signal of the subordinate or cascade-control unit including the signal comparing stage 24 whose output signal initiates adjustments of the valving element of the steam regulating valve 16 in the conduit 14. The signal comparing stage 24 further receives signals from the monitoring circuit 27, and such signals denote the actual quantity of steam which is supplied to the dryer 1 per unit of time via conduit 14. When the intensity or another characteristic of the signal denoting the value $\Delta w$ changes, i.e., when the quantity of moisture which is to be evaporated per unit of time changes (such changes can take place because the quantity of tobacco particles 67 per unit length of the stream changes and/or because the initial moisture content fa of tobacco changes), the output of the signal comparing stage 24 transmits a signal which is indicative of the difference between the intensities of signals from 31 or 41 and 26 on the one hand and from the computer 22 on the other hand, and such output signal is amplified by the amplifier 36 prior to being applied to the servo 37 which adjusts the valving element of the regulating valve 16 accordingly. The position of the valving element determines the rate of steam flow or the pressure of steam flowing from the source 13 into the dryer 1 via discharge end 17 of the conduit 14. If the quantity of moisture which is to be expelled from tobacco particles 67 per unit of time decreases, the rate of admission of steam into the dryer 1 increases so that the heated wall 1*a* and the pipes 56 cannot expel excessive quantities of moisture from tobacco which advances from the chute 47 toward the chute 61. However, if the quantity of moisture to be expelled per unit of time increases, the quantity of steam which the conduit 15 admits into the dryer 1 per unit of time is reduced so that heat which is supplied by the wall 1*a* and pipes 56 can expel a greater quantity of moisture from tobacco particles 67 which advance from the chute 47 toward the chute 61. Such mode of regulating the rate of steam admission into the dryer 1 entails a very rapid and effective conformance of the quantity of admitted steam to the quantity of heat which the wall 1*a* and pipes 56 transmit for the heating and drying of tobacco particles in the dryer 1. This is accomplished without necessitating any adjustment or regulation of steam admission into the pipes 56, i.e., without any adjustment of a regulation which is relatively slow so that it could not compensate for rapidly changing initial moisture content fa and/or for rapidly changing rate of tobacco admission into the drum 1. However, and as explained above, long-range deviations of initial moisture content fa from an anticipated initial moisture content and/or of the rate of tobacco admission into the dryer 1 from anticipated rate of admission can be effectively compensated for by the control unit 40.

The aforediscussed subordinate or cascade-control unit including the parts 28 through 37 can be replaced with a unit which can regulate the pressure (rather than quantity) of steam supplied via conduit 14. This presents no problems since the pressure of steam can be regulated in a very simple and efficient manner.

The aforediscussed modes of regulating the heating and moisture expelling action upon the particles of a continuous tobacco stream can be resorted to with equal advantage (or with even greater advantage) when the quantity of moisture which is to be expelled in order to ensure that the final moisture content fe matches or very closely approximates a desired or optimum final moisture content is small or extremely small or that the pressure of steam which is needed to heat the wall 1*a* would be too low. The control unit 18 is then designed in such a way that when the intensity or another characteristic of the signal denoting the value of $\Delta w$ (i.e., of the signal at the output of the computer 22) does not reach a predetermined minimum value, the threshold circuit 23 must transmit a signal (denoting that such circumstances prevail) before the control unit 18 is activated and becomes effective to open the (normally closed) valve 16 in the conduit 14. On the other hand (and assuming that the apparatus embodies the threshold circuit 23, i.e., that the valve 16 is normally closed), under normal operating conditions the heating action is furnished exclusively by the means for heating the wall 1*a* and pipes 56 and/or by another available heat energy supplying means (such as the source 8 of heated air; the conduit 11 then contains or can contain a valve which corresponds to the valve 16 and is adjustable in response to signals from the output of the computer, as long as the intensity of such signals is greater than that required to activate the control unit 18 via threshold circuit 23).

Changes in the rate of steam admission via discharge end 17 of the conduit 14 would entail corresponding changes in the flow of tobacco through the dryer 1 if the rate of extraction of vapors by the fan 73 would remain unchanged. In order to prevent or reduce the likelihood of such changes in the rate of tobacco flow from the chute 47 to the chute 61, the conductor means 71 transmits the output signal of the signal comparing stage 24 in the control unit 18 to the signal comparing stage 74 in the control unit 72, and such signal constitutes a reference signal. When the intensity or another characteristic of such reference signal changes, the signal comparing stage 74 transmits a signal which is amplified by the amplifier 77 and causes the servo 78 to adjust the adjustable flow restricting valve 83 accordingly, namely, so that the rate at which vapors are withdrawn from the dryer 1 per unit of time remains constant.

An important advantage of the improved apparatus is that it can ensure the presence of optimal quantities of moisture in the treated tobacco even if the quantity (G), initial moisture content (fa) or each of these parameters varies within a wide range. This is achieved by the simple expedient of artificially increasing the overall quantity of moisture in the conditioning zone 101 when the total quantity of moisture supplied into the dryer 1 by incoming tobacco per unit of time is less than anticipated, and vice versa.

Another important advantage of the improved apparatus is that it can effectively prevent overdrying of tobacco when the initial moisture content of tobacco and/or the quantity of tobacco which is admitted into the conditioning zone 101 is so low that the final moisture content (fe) of treated tobacco would be below an optimum value. This is achieved by the provision of the aforementioned threshold circuit 23 which activates the control unit 18 only when the value of $\Delta w$ is below a predetermined minimum acceptable value, namely, below a value at which the heating action of steam upon the dryer 1 and pipes 56 is excessive even if the pressure of steam which is admitted into the pipes 56 via adjustable regulating valve 58 is reduced to the lowest acceptable value.

If the apparatus embodies the threshold circuit 23, the vale 16 is normally closed and the apparatus then preferably comprises a second conduit connecting the source 13 with the inlet of the dryer 1 to normally admit steam into the conditioning zone 101, namely, to admit steam in response to those signals at the output of the computer 22 whose intensity exceeds the intensity of the signal that triggers the transmission of a signal via threshold circuit 23. Alternatively, the apparatus can then comprise an adjustable regulating valve in the conduit 11 and means for adjusting such valve in response to those signals which trigger adjustments of the valve 16 in the absence of the threshold circuit 23. Still further, and in addition to or in lieu of a regulating valve in the conduit 11, the apparatus can then regulate the heating action exclusively by changing the pressure of steam in the pipes 56, as long as the intensity of signal at the output of the computer 22 exceeds the intensity at which the threshold circuit 23 renders the control unit 18 operative.

It will be noted that the provision of the threshold circuit 23 enables the apparatus to adequately regulate the expulsion of moisture from tobacco within a range which is much wider than is possible in heretofore known apparatus. A rise of temperature of tobacco in the conditioning zones 101 is not detrimental because the temperature of tobacco leaving the dryer is normally rather high, even when the initial moisture content of tobacco is not lower than anticipated and, furthermore, it is often desirable to heat tobacco in the dryer to an elevated temperature in order to enhance the filling properties of tobacco.

As explained above, the means for regulating the pressure of steam in the pipes 56 in the conditioning zone 101 is adjusted in response to signals (furnished by the amplifier 44) which are a function of the monitored final moisture content fe of tobacco. The monitoring means includes the components 65 and 66. As also mentioned above, the pressure of steam in the pipes 56 should not be reduced to a very low value because this would adversely influence the predictability of drying action upon tobacco particles 67 in the conditioning zone 101. Under such circumstances, the apparatus preferably embodies the threshold circuit 23 which thus enables the apparatus to properly treat tobacco particles whose initial moisture content is much lower than anticipated and/or tobacco particles which are supplied to the dryer in relatively small or very small quantities so that, in the absence of admission of steam via conduit 14 and valve 16, it would be necessary to reduce the pressure of steam in the pipes 56 well below the minimum acceptable value.

The admission of at least some hot air into the conditioning zone 101 is desirable, advantageous or necessary in many types of tobacco conditioning apparatus. As mentioned above, the rate of admission of hot air via conduit 11 can be regulated, for example, as disclosed in the aforementioned patent to Koch et al., i.e., as a function of fluctuations of the initial moisture content fa of tobacco particles 67.

The placing of discharge ends 12 and 17 of the conduits 11 and 14 close to or in immediate proximity of each other, and preferably close or very close to the locus where the chute 47 feeds particles 67 of tobacco into the inlet of the dryer 1 contributes to more predictable flow conditions in the conditioning zone 101.

As explained above, extraction of vapors via hood 70 and conduit 81 also contributes to more predictable and more satisfactory flow conditions in the interior of the dryer 1. The valve 81 is designed to restrict the flow of vapors from the interior of the dryer 1 toward the fan 73 in such a way that the rate of vapor extraction decreases in response to decreasing rate of steam admission via conduit 14 and vice versa.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claim.

We claim:

1. Apparatus for conditioning moisture-containing tobacco or a similar moisture-containing smokable material, comprising a transporting unit including a hollow rotary dryer defining a conditioning zone for the passage of a stream of moisture-containing smokable material therethrough; means for heating said dryer so that the latter transmits heat to and thereby expels moisture from the material during transport through said zone; and control means including means for monitoring the quantity of moisture in the material entering said zone per unit of time, a source of steam, adjustable steam admitting means for admitting steam from said source into said zone, and adjusting means for adjusting said steam admitting means so as to increase the quantity of admitted steam per unit of time when the quantity of moisture in the material entering said zone per unit of time decreases and vice versa.

2. The apparatus of claim 1, wherein said monitoring means includes means for generating first signals denoting the initial moisture content of material entering said zone and said control means further comprises means for processing such signals including means for generating second signals denoting the quantity of moisture to be expelled from material in said zone per unit of time so as to ensure that the moisture content of material leaving said zone will at least approximate a predetermined value, said adjusting means being responsive to said second signals.

3. The apparatus of claim 2, wherein said means for heating said dryer includes a source of heated fluid.

4. The apparatus of claim 3, wherein the fluid which heats said dryer is steam.

5. The apparatus of claim 2, wherein said processing means comprises a computer having a first input for said first signals, a second input, and an output for said second signals, said control means further comprising means for monitoring the quantity of material entering said zone per unit of time and including means for transmitting to said second input third signals denoting the monitored quantity of material.

6. The apparatus of claim 2, further comprising conduit means connecting said source with said zone, said admitting means including an adjustable regulating valve in said conduit means.

7. The apparatus of claim 2, further comprising means for activating said adjusting means when the quantity of moisture in material which is admitted into said zone per unit of time drops below a predetermined value.

8. The apparatus of claim 7, wherein said processing means comprises a computer having a first input for reception of signals from said monitoring means and an output for transmission of signals to said adjusting means, said activating means comprising a threshold circuit between said output and said adjusting means.

9. The apparatus of claim 1, wherein said heating means is adjustable and further comprising second control means having means for monitoring the moisture content of material issuing from said zone and means for adjusting said heating means when the monitored moisture content of material leaving said zone deviates from a predetermined value.

10. The apparatus of claim 1, wherein said dryer has an inlet and said transporting unit further comprises means for feeding material to a predetermined portion of said inlet, said control means further comprising conduit means for conveying steam from said source to said dryer and said conduit means having a steam discharging end adjacent to said predetermined portion of said inlet.

11. The apparatus of claim 1, wherein said dryer has an inlet and said transporting unit further comprises means for feeding material to a predetermined portion of said inlet, and further comprising a source of heated fluid and conduit means for admitting heated fluid from said last named source to said inlet, said conduit means having a discharge end adjacent to said predetermined portion of said inlet.

12. The apparatus of claim 1, wherein said dryer has an inlet and said control means further comprises first conduit means connecting said source with said conditioning zone and having a steam discharging end in the region of said inlet, and further comprising a source of a heated gaseous fluid and second conduit means connecting said last named source with said zone, said second conduit means having a discharge end adjacent to the discharge end of said first conduit means.

13. The apparatus of claim 12, wherein said heated gaseous fluid contains oxygen.

14. The apparatus of claim 1, wherein the heating of material in said dryer entails the development of vapors and further comprising means for evacuating vapors from said zone.

15. The apparatus of claim 14, wherein said evacuating means comprises conduit means for extraction of vapors from said zone, adjustable flow restricting means in said conduit means, and means for adjusting said flow restricting means as a function of the rate of admission of steam from said source into said dryer.

16. The apparatus of claim 15, wherein said last named adjusting means is arranged to increase the rate of extraction of vapors from said zone when the rate of admission of steam into said dryer increases and vice versa.

* * * * *